US010420381B2

(12) United States Patent
Tulloch

(10) Patent No.: US 10,420,381 B2
(45) Date of Patent: Sep. 24, 2019

(54) FINGER JACKET

(76) Inventor: Kabede B. Tulloch, Boston, MA (US)

( * ) Notice: Subject to any disclaimer, the term of this patent is extended or adjusted under 35 U.S.C. 154(b) by 0 days.

(21) Appl. No.: 13/374,127

(22) Filed: Dec. 13, 2011

(65) Prior Publication Data

US 2012/0151652 A1 Jun. 21, 2012

Related U.S. Application Data

(60) Provisional application No. 61/459,582, filed on Dec. 16, 2010.

(51) Int. Cl.

| | |
|---|---|
| ***A41D 13/00*** | (2006.01) |
| ***A41D 13/08*** | (2006.01) |
| ***A63B 71/14*** | (2006.01) |

(52) U.S. Cl.

CPC ..... *A41D 13/087* (2013.01); *A63B 71/14* (2013.01)

(58) Field of Classification Search

CPC ..... A63B 71/14; A41D 13/087; A41D 19/015
USPC ..... 2/21, 159, 161.1, 161.3, 161, 163; 602/58

See application file for complete search history.

(56) References Cited

U.S. PATENT DOCUMENTS 1,358,823 A * 11/1920 Burden ..... 2/163
1,358,824 A * 11/1920 Burden ..... A41D 19/015 2/161.8
1,483,595 A * 2/1924 Read ..... 473/205
2,039,505 A * 5/1936 Vollmer ..... 2/21
2,103,594 A * 12/1937 Murray ..... 2/160
2,118,463 A * 5/1938 Eden ..... 2/163
2,179,614 A * 11/1939 Cohen ..... 15/227
2,285,981 A * 6/1942 Johns ..... 2/21
2,447,951 A * 8/1948 Lindfelt ..... 2/167
2,474,030 A * 6/1949 Braswell ..... 473/205
2,710,971 A * 6/1955 Hall ..... 2/161.8
2,740,121 A * 4/1956 Seidel ..... 2/21
2,847,005 A * 8/1958 Bourne ..... 602/58
3,348,541 A * 10/1967 Loebeck ..... 602/58
4,131,952 A * 1/1979 Brenning, Jr. ..... 2/16
4,194,736 A * 3/1980 Loafman ..... 473/61
4,269,181 A * 5/1981 Delannoy ..... 602/58
4,590,625 A * 5/1986 Keim ..... 2/161.3
4,651,350 A * 3/1987 Dawiedczyk ..... 2/158
4,654,895 A * 4/1987 Peters ..... A41D 19/0017 2/161.1
4,751,747 A * 6/1988 Banks et al. ..... 2/21
4,867,246 A * 9/1989 Kiger ..... 172/370
4,881,275 A * 11/1989 Cazares et al. ..... 2/161.1
5,517,692 A * 5/1996 Wunderlich-Kehm ..... 2/21
5,554,076 A * 9/1996 Clark ..... 473/61
5,577,272 A * 11/1996 Fisher ..... 2/21
5,642,525 A * 7/1997 Ketola ..... 2/16
5,680,654 A * 10/1997 McClanahan, II ..... 2/163

(Continued)

*Primary Examiner* — Richale L Quinn
(74) *Attorney, Agent, or Firm* — H. Jay Spiegel

(57) ABSTRACT

Finger jackets have an improved fit for use in conjunction with various sports, athletic and special use activities. Each finger jacket has a palmar face portion and a back portion joined together to fit each human finger and adapted to fit various sizes thereof. The back portion is formed of a stretchable breathable material. The palmar face portion of each finger jacket is made of a sheet of anti-slip, grip enhancing material. Fourchettes may be connected between the palmar and back portions. Fasteners such as zippers and hook and pile fasteners may be employed.

13 Claims, 4 Drawing Sheets

(56) References Cited

U.S. PATENT DOCUMENTS

| | | | | |
|---|---|---|---|---|
| 5,991,926 | A * | 11/1999 | Lakusiewicz | A41D 19/01558 2/161.1 |
| 6,049,022 | A * | 4/2000 | Tseng et al. | 602/41 |
| 6,243,868 | B1 * | 6/2001 | Wanzenried | A41D 13/087 2/21 |
| 6,307,118 | B1 * | 10/2001 | Reich | 602/42 |
| 6,647,549 | B2 * | 11/2003 | McDevitt et al. | 2/21 |
| 6,839,905 | B1 * | 1/2005 | Bruder et al. | 2/21 |
| 7,012,169 | B2 * | 3/2006 | McDevitt et al. | 602/41 |
| 7,127,771 | B2 * | 10/2006 | McDevitt et al. | 15/227 |
| 7,887,462 | B1 * | 2/2011 | Bearden | 482/44 |
| 8,458,817 | B1 * | 6/2013 | Babb | 2/163 |
| 2002/0152538 | A1 * | 10/2002 | McDevitt et al. | 2/163 |
| 2004/0045071 | A1 * | 3/2004 | Robins | 2/21 |
| 2005/0155134 | A1 * | 7/2005 | McLin | A41D 19/00 2/161.6 |
| 2006/0185057 | A1 * | 8/2006 | Terpinski | 2/160 |
| 2008/0005822 | A1 * | 1/2008 | Lavner et al. | 2/21 |
| 2012/0297515 | A1 * | 11/2012 | Mysyk | 2/21 |

* cited by examiner

FINGER JACKET

This application claims priority from the earlier filed Provisional application Ser. No. 61/459,582, filed on Dec. 16, 2010. The present invention relates to finger jackets for the human fingers, and more particularly to finger jackets having superior fit and grip, while still providing the wearer protection and an increased sense of touch, movement and flexibility. Finger jackets are for use in conjunction with various sports, athletic activities and special use activities. Having a non-slip material specifically chosen and applied on the palmar side of the fingers facilitates enhanced gripping abilities. Finger jackets provide an advantageous combination of features, including good flexibility, wear resistance, ventilation, protection and the ability to greater sense, feel, touch, grip and grasp onto more tightly, objects in the palm of the wearer.

FIELD OF THE INVENTION

The present invention relates to finger jackets for the human fingers, and more particularly to finger jackets having superior fit and grip, while still providing the wearer protection and an increased sense of touch, movement and flexibility. Finger jackets are for use in conjunction with various sports, athletic activities and special use activities. Having a non-slip material specifically chosen and applied on the palmar side of the fingers facilitates enhanced gripping abilities. Finger jackets provide an advantageous combination of features, including good flexibility, wear resistance, ventilation, protection and the ability to greater sense, feel, touch, grip and grasp onto more tightly, objects in the palm of the wearer.

BACKGROUND OF THE INVENTION

The present invention relates to embodiments of finger jackets. In an effort to improve protection, grip, movement, flexibility and tactile response for the human hand, a number of prior art references disclose a myriad of practical and impractical designs and related devices. Two well known applications which disclose the use of gloves and the use of finger sleeves are the most common.

As an example, a number of devices purporting to improve grip and tactile response when catching a football have been tried. For the most part, gloves with a treated leather palm have mainly been employed to improve grip and tactile response. Though these gloves have done a fairly effective job in this regard, they, for the most part, have fallen short of their desired intention. Many existing gloves may provide some protection, finger motion and gripping characteristics, however, the sensitivity, range of motion and tactile response provided by such gloves are generally significantly inferior to those of the bare human hand. The finger stalls of these gloves do a great job of helping to provide the grip, however, the sensitivity and tactile response of prior art gloves are considerably lacking. The problem, however, arises due to the structure of the palmar surface area of prior art gloves. Though the intention is to provide added surface area with which a ball may have contact in use, the added surface area ends up being the very reason these gloves have proven themselves ineffective in providing both superior grip and tactile response. The palmar piece of prior art gloves tends to bunch up, forming ripples, or is stretched out over and across the surface area of the palm, however, not necessarily on, or in contact with the palm itself. This creates a situation in which the palmar piece does not always lay flat against the palm of the wearer's hand at all times, thus creating a significant loss of sensitivity and tactile response with respect to the palm of the wearer.

The following prior art is known to Applicant:

U.S. Pat. No. 4,763,940 to Held discloses a document handling aid having a resilient tubular body with first and second joined body sections. Both ends of the tubular body are open so that when mounted on a finger, the tip of the finger protrudes from the first body section adjacent thereto. The second body section grips the finger at about the first knuckle and has a plurality of generally parallel longitudinal cuts therethrough to permit enhanced radial expansion of the tubular body adjacent the first knuckle of the finger.

U.S. Pat. No. 4,926,851 Bulley discloses a tubular bandage comprising a length of tubular fabric knitted from a combination of substantially inelastic yarn and elastic yarn so as to have alternating circumferential rows of inelastic yarn and elastic yarn, and having a first end portion rolled outwardly from the free end and the other end portion rolled inwardly from the opposite free end to form two rolls each constituted by nearly half the bandage.

U.S. Pat. No. 5,511,248 to Widdemer discloses an improved design for an anti-slip glove. The surface of the glove is adapted to provide an especially strong bond between the palm and/or fingers of the glove and a club, racket or other piece of sports equipment which the wearer is holding, pulling or pushing. The improved anti-slip glove utilizes a thermoplastic polyurethane film panel, incorporated into the glove's design at key pressure points, which is selected to exhibit a strong physical bond with the rubber, plastic, leather or other composite materials used to manufacture the hand grips that are a part of hand-held sporting equipment. The anti-slip panel may be attached separately to the palm and fingers of the glove or made an integral part of the glove. When made an integral part of the glove's design and manufacture, the improved anti-slip glove may also incorporate a non-slip backing material positioned between the wearer's hand and the rear surface of the thermoplastic polyurethane film panel, to provide a tight coupling between the surface of the wearer's hand and the body of the glove to reduce slippage of the hand within the glove.

U.S. Pat. No. 5,577,272 to Fisher discloses finger sleeves of varying length that extend beyond a user's finger in order to facilitate one-handed basketball dunks.

U.S. Pat. No. 6,408,442 to Kang discloses an athletic glove and, more particularly, an improved anti-slip glove, especially for use in conjunction with various athletic activities, having a palm surface printed with a pattern of silicone sealant and exhibiting a durable and consistent gripping ability over a variety of moisture conditions. Finger sleeves have also been used in the prior art to enhance grip and tactile response. Finger cots, rubber finger tips, finger sleeves and the like have all been called upon to do so. Prior art teachings have done a fairly good job of helping the finger in each of their intended use scenarios. Recently, finger sleeves have come into widespread use in sports such as basketball and volleyball. Athletic finger sleeves used in these sports are generally made of sponge foam or sponge rubber padding, certain polymers, knit yarn or other materials. Finger sleeves used in athletics in the past, however, have mainly been used as protection for the fingers of the athlete against injury.

U.S. Pat. No. 6,647,549 to Mcdevitt et al. discloses a finger glove that can be used as a substitute for cotton balls, swabs, and/or gauzes, or as an oral cleaning device.

U.S. Pat. No. 6,839,905 to Bruder et al. discloses a protective skin device that may be used to protect the fingers, thumb, and a portion of the hand of the wearer. The device is configured to be worn about a digit, and the device provides cushioning and aids in gripping. The device includes a sheath with one or more projections, and the sheath may be perforated. The device may include an opening that exposes a joint. The device also may include a palmar pad, which covers a portion of the hand and may include multiple sheaths connected with a membrane, and multiple devices may be worn on the same or separate digits.

U.S. Pat. No. 7,530,120 to Morrow et al. discloses a protective sports glove consisting of a padded outer glove and an inner form-fitting glove. The padded outer glove is similar to conventional protective gloves used in contact sports, but having a substantial portion of the palm removed (i.e., except for the finger palm portions). The smaller form-fitting glove is introduced to the wearer's hand prior to insertion within the padded outer glove and covers the cutout palm portion of the padded outer glove. In essence, the form-fitting glove acts as the palm portion for the padded outer glove.

In football, the use of finger jackets would be a major benefit for the athlete. Not having a palmar piece leads to an improved sense of touch. In the split second it takes for the hand to feel the ball in its palm and close around it, the sense of touch required is paramount. Covering the palm with material, though the material is intended to provide added grip, takes away from the natural feel of the palm of the hand against the ball, thus tactile response is reduced. A greater number of football players prefer the natural feel of the ball in the palms of their hands. By providing finger jackets, which only cover the fingers of these athletes, with their enhanced gripping capabilities and not covering the palm, an enhanced sense of touch is achieved and a tighter grip possible.

While a particular embodiment has been chosen to illustrate the invention, it will be understood by those skilled in the art that various changes and modifications can be made therein without departing from the scope of the invention as defined in the appended claims.

SUMMARY OF INVENTION

The present invention relates to embodiments of finger jackets.

The present invention includes the following objects, aspects and features:

(1) In an effort to improve grip and tactile response to the human hand and overcome the above drawbacks of conventional finger sleeves and athletic gloves, the present invention provides a finger jacket with enhanced gripping and anti-slip capabilities. Such a finger jacket has a palmar facing portion made of a specifically chosen anti-slip material exhibiting improved mating and gripping ability that is consistent over various moisture conditions while maintaining protection, flexibility, and tactile response.

(2) In one embodiment, the improved finger jacket is adapted for use in football. In this configuration, each finger jacket incorporates a specifically chosen anti-slip panel on its palmar face portion. This specifically chosen anti-slip material exhibits exceptional mating characteristics while grasping a football, resulting in an enhanced gripping capability.

(3) In accordance with the preferred embodiment of the present invention, there is provided a finger jacket providing the wearer protection, an improved fit, improved tactile response, flexibility and superior gripping characteristics. The finger jacket generally comprises a palmar face portion and a back piece which are joined together along their seams, in a conventional manner, to fit human fingers. The palmar face portions of the five finger jacket stalls are fabricated from a sheet of specifically chosen anti-slip material.

(4) Finger jackets made in accordance with the present invention each comprise a thin, durable, form-fitting finger jacket having superior gripping characteristics over currently known and marketed finger sleeves and gloves. In this regard, a thin, uniform layer of silicone sealant material forms a continuous coating covering palmar face piece of each of the finger jackets and provides a sure, natural feel, superior mating, and tactile response not found in prior art finger sleeves and gloves. The finger jackets of the present invention further eliminate slipping against the fingers of the wearer. To do so, a rough or sticky surface or pattern is embossed, affixed or otherwise made a part of the surface of the backing material and of the palmar face pieces. The combination of these properties makes the finger jackets of the present invention ideal for both professional and amateur sports and/or special use activities in which manual dexterity is paramount.

As such, it is a first object of the present invention to provide a finger jacket having improved gripping characteristics.

It is a further object of the present invention to provide a finger jacket that does not slip against the fingers of the wearer.

It is a still further object of the present invention to provide a finger jacket that does not inhibit finger motion, feel, or tactile response.

It is a yet further object of the present invention to provide a finger jacket wherein a stretchable fabric is used to form the dorsal part of the finger jacket, providing for a snug fit upon a wearer's finger.

It is a further object of the present invention to provide a finger jacket having stretchable fibers also made breathable to provide air flow to the fingers.

It is a yet further object of the present invention to provide a finger jacket which is comfortable to wear and attractive to view.

It is a still further object of the present invention to provide a finger jacket which may be used in environments not limited to athletics.

It is a yet further object of the present invention to provide a finger jacket which is inexpensive to manufacture.

It is a still further object of the present invention to provide a finger jacket wherein its palmar face portions of finger stalls may be fabricated from a specifically chosen sheet of anti-slip material.

It is a still further object of the present invention to provide a finger jacket further comprising fourchettes.

It is a yet further object of the present invention to provide a finger jacket having a front portion combined with the back portion adapted to fit a wide variety of finger sizes snugly.

It is a still further object of the present invention to provide a finger jacket which is lightweight and durable.

It is a further object of the present invention to provide a finger jacket that may be securely fastened to a wearer's finger.

It is a still further object of the present invention to provide a finger jacket for protecting the fingers from injury.

It is a yet further object of the present invention to provide a finger jacket for use in a variety of special use applications.

It is a still further object of the present invention to provide a finger jacket that does not restrict finger movement while exhibiting high flexibility characteristics.

It is a yet further object of the present invention to provide a finger jacket made up of five separate finger sleeves of varying lengths to correspond to the lengths of a user's fingers and positionable thereon.

It is a still further object of the present invention to provide a finger jacket made to fit different finger sizes having a closed end and an open end for receiving said fingers.

It is a still further object of the present invention to provide a finger jacket with front and back portions joined together at their seams in a conventional manner.

It is an additional object of the present invention to provide an anti-slip finger jacket which overcomes the limitations of the prior art.

Further objects and advantages of the present invention will become apparent to those skilled in the art upon reading and consideration of the following description of the preferred embodiments in connection with the accompanying drawings.

SPECIFIC DESCRIPTION OF THE PREFERRED EMBODIMENTS

The embodiments of the present invention will now be described more fully hereinafter with reference to the accompanying drawings, in which some examples of the embodiments of the inventions are shown. Indeed, these inventions may be embodied in many different forms and should not be construed as limited to the embodiments set forth herein. Rather, these embodiments are provided by way of example.

Figure 1:
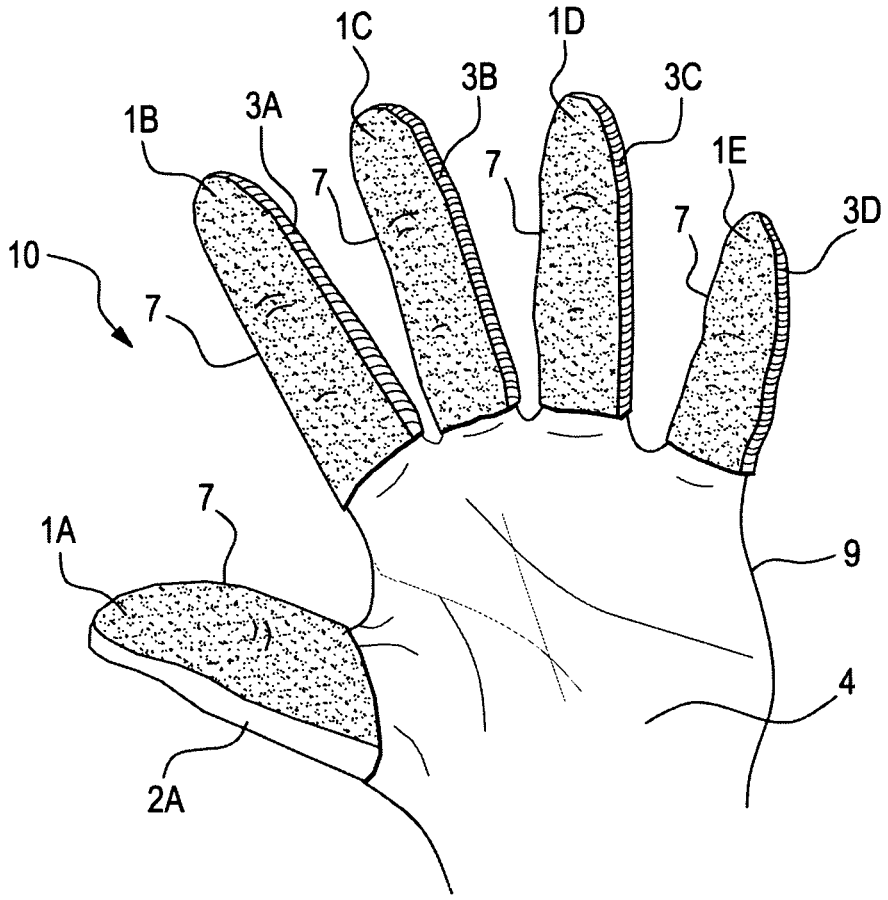
FIG. 1 shows a flat palmar view of a hand wearing finger jackets.

With reference to FIG. 1, a palmar view of the human hand 9 having a palm 4 is shown wearing finger jackets 10. Finger jackets 10 for the user's thumb, forefinger, middle finger, ring finger and pinkie finger are comprised of a palmar face portion 1*a*-1*e*, and a back portion 2*a*-2*e* cut to fit the fingers of the human hand and joined along the seams 7 thereof in a conventional manner. The palmar face portions 1*a*-1*e* of finger jackets 10 are comprised of a specifically chosen anti-slip, grip enhancing material, chosen based on specified use. Such materials include synthetic or natural rubber, leather, suede, synthetic leather and a number of other slip resistant, grip enhancing materials that may be employed in the present invention without departing from its scope.

Fourchettes 3*a*-3*d* (FIGS. 1 and 3) may be employed between the front and back portions of each finger jacket 10, excluding the thumb. Fourchettes 3*a*-3*d* comprise narrow strips of material joining the front and back sections of the fingers of gloves. They are used to help the finger jackets 10 remain open enough so that a user's fingers may be inserted more readily. They also aid in providing a more comfortable fit and a more attractive finger jacket 10. The back portions 2*a*-2*e* are comprised from materials that are both stretchable and breathable such as porous elastic materials and/or a mixture thereof. Using a breathable stretchable material allows the fingers proper ventilation and a nice taut fit. Finger jackets 10 are designed to help protect the fingers while providing enhanced tactile response and gripping capabilities to the wearer. Finger jackets 10 are configured to protect the fingers, while permitting maximum movement, ventilation, and tactile sensation. Having no palmar piece to reduce sense of touch is an added benefit of the present invention because it provides the user a greater sense of touch by allowing the wearer the ability to better feel what may be in palm of the hand, over that of any glove, while still providing the enhanced gripping capabilities provided by the finger jackets 10. Depending on the material used for the palmar face portions 1*a*-1*e* of the finger jackets 10, a perspiration absorbing material may be embossed, affixed or otherwise made part of the surface of the backing material, of the palmar face pieces 1*a*-1*e*, of each finger jacket 10 to aid in the preventing of perspiration build-up, and slippage against the fingers of the wearer.

Figure 2:
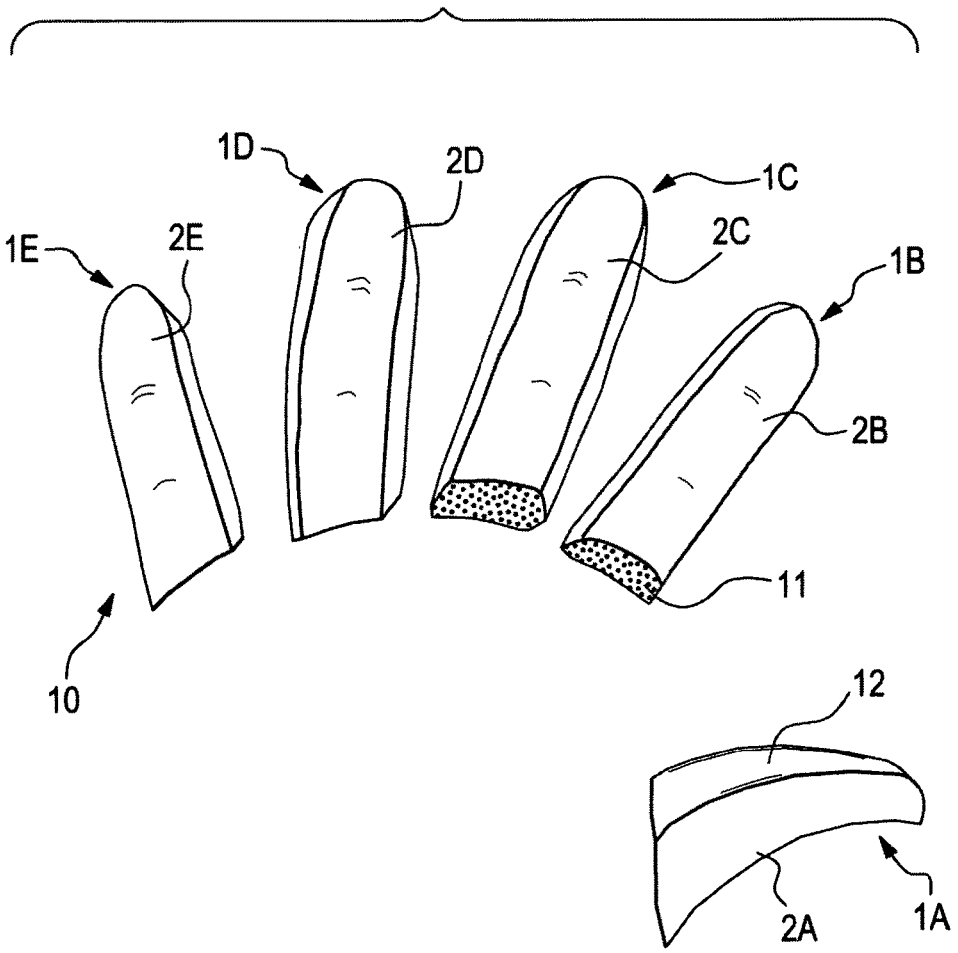
FIG. 2 shows the inventive finger jackets laid out in their simplest form having no zipper, no VELCRO fastener, or extra added anti-slip material about the thumb or index fingers to show detail.

With reference to FIG. 2, in the preferred embodiment, the palmar pieces 1*a*-1*e* are each comprised of a sheet of leather including an inside surface having a grain finish 11 and an outside surface having a split finish 12. Importantly, the sheet of leather is prepared by a chrome tanning process. The chrome tanning process utilizes a solution of basic chrome sulfate, and has the advantage of providing a reduced oil content within the leather. Because finger jackets 10 are intended to provide a secure grip for an individual engaging in athletic and special use activities, it is important that the sheet of leather from which the palmar face pieces 1*a*-1*e* are fabricated have the ability to absorb perspiration that may build up on the fingers. Such moisture absorption and wicking characteristics may be provided by the microporous structure of the material. Additionally, the sheet of leather must be sufficiently thin and supple so as not to interfere with the finger movements of the wearer during a regular use or athletic activity. A thickness of between 0.1 mm to 0.5 mm is recommended for most applications but may not be considered limiting. In the preferred embodiments, a thickness closer to 0.1 mm is recommended. This thickness is intended to help improve the sense of touch while still greatly improving one's ability to catch, grip, hold onto, or throw a football. The thinner the material used the greater the tactile response will be. Moreover, the sheet must provide a tactile response to the wearer from objects the wearer is handling. In this regard, a thin sheet of leather material is preferred. As previously stated, artificial leather, such as synthetic suede, which has water absorbing and wicking characteristics similar to that of leather may be utilized as an alternative to leather. As previously stated, back piece 2*a*-2*e* of finger jackets 10 may be made fabricated from any suitable flexible, supple, form-fitting material or breathable, stretchable materials including woven and knit fabric polyester, spandex, lycra, polypropylene, and/or a mix thereof. Stretchable fabrics are particularly suitable because of their light weight, flexibility and durability. Moreover, because of the porous nature of such fabric materials, such materials do not tend to trap perspiration inside finger jackets 10, but rather permit such perspiration to freely evaporate.

With further reference to FIG. 2, the dorsal view of finger jackets 10 is shown. The material on the dorsal portion of each finger jacket, 2*a*-2*e*, are comprised of chosen breathable, elastomeric material, and/or a mix thereof. This material is chosen in an effort to provide ventilation and a more snug fit for a wide range of finger sizes.

Figure 5:
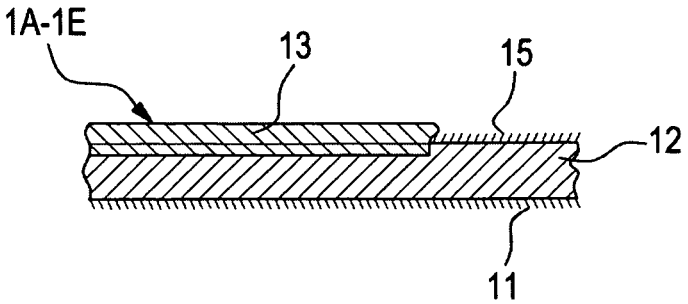
FIG. 5 shows the details of the multi-layered palmar pieces.

As can be easily appreciated, when worn by a user, the inside surface 11 (FIG. 2) of finger jackets 10 lies against and is configured to directly physically contact against the fingers of the hand of the wearer while the outside surfaces 12 come into physical contact with objects handled by the wearer. In the phrases "lies against" and "directly physically contacts against," Applicant, acting as his own lexicographer, states that the meaning of "against" is as defined in www.dictionary.com: "5. in contact with . . . " or as defined in the 1980 Random House Dictionary: "3. in contact or collision with." In order to enhance and facilitate the gripping characteristics of finger jackets 10 for athletic and special use activities, non-slip material 1*a*-1*e* is used for the palmar face surfaces. In the preferred embodiment, the Applicant has found that superior results are achieved by use of a sheet of leather material, which has been prepared by a chrome tanning process and has a grip enhancing substance such as a silicone sealant compound 13 applied thereto (FIG. 5). Such silicone sealant 13 offers superior adhesion to split leather surfaces as well as possesses superior elasticity necessary for continuous athletic and special use activities. Further such silicone sealant 13 possesses significant chemical, fire and thermal resistivity and yields a tacky but non-yielding tactile feel. In the preferred embodiment, a Dow Corning general purpose, one-part silicone sealant is utilized, however, other silicone sealants having similar properties are contemplated herein. (Dow Corning is a registered trademark of Dow Corning Corporation, Midland, Mich.)

Figure 4:
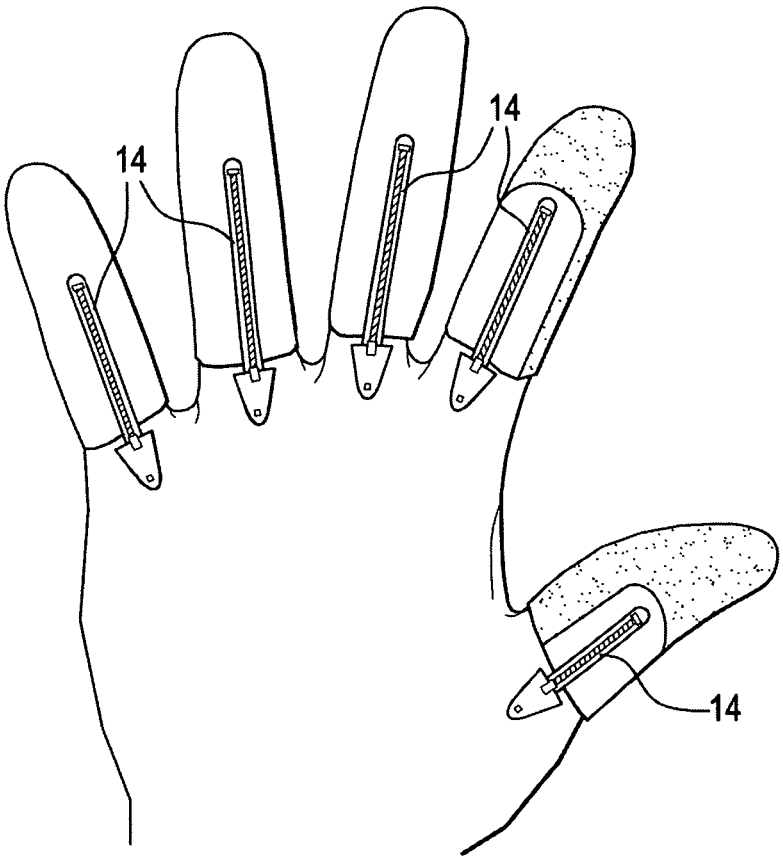
FIG. 4 shows a dorsal view of an alternative embodiment of finger jackets having a zipper placed along the back of each finger jacket and added anti-slip grip enhancing material added about the thumb and forefinger.

FIG. 4 identifies a further embodiment of finger jackets 10 where the thumb and forefinger have added anti-slip, grip enhancing material about them to further provide an enhanced grip between these fingers. Sometimes, people use these fingers to pick things up and the added anti-slip material enhances the grip and tactility between these fingers.

As shown in FIG. 4, a releasable fastener such as a zipper 14 is placed along the back portion of each finger jacket 10. To avoid inhibiting flexibility of the fingers, the zippers 14, which are placed on the back portion of the finger jackets 10 for the index finger, middle finger, ring finger, and pinkie finger should begin just below the proximal interphalangeal joint and continue along to the base of each such finger near to or just below each respective knuckle. The zipper 14 for the thumb should begin just below its own interphalangeal joint to or just below its own knuckle.

Figure 3:
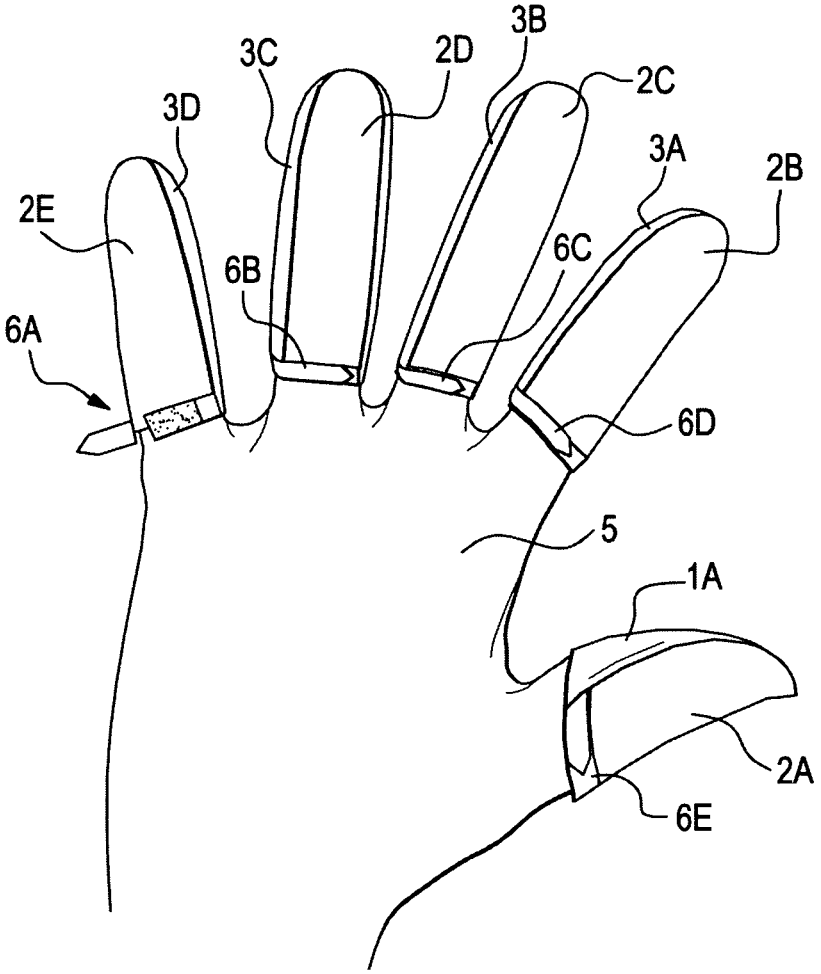
FIG. 3 shows a dorsal view of an alternative embodiment of finger jackets having hook and pile fasteners.

FIG. 3 shows an illustration of the dorsal view of the human hand 5 wearing finger jackets 10. This embodiment shows a variation of finger jackets 10 having releasable fasteners comprising hook and loop fasteners 6*a*-6*e* at the base of each finger jacket 10 at least partially surrounding an opening at the base of each finger jacket. Items 6*b*-6*e* are intended to show fasteners in their closed state, while 6*a* shows fasteners in their open state.

Referring now to FIG. 5, in the preferred embodiment, outside surface 12 of palm pieces 1*a*-1*e* have a split finish defining a plurality of exposed fibers 15. Such a fibrous structure is advantageous due to the mechanical interconnection that takes place between fibers 15 and material 13, thereby enhancing the bonding process therebetween. Additionally, because the sheet of leather material comprising palmar face pieces 1*a*-1*e* is microporous material, the outside surface 12 may be coated with material 13 as also shown in FIG. 5. Importantly, however, material 13 does not penetrate the entire thickness of the palm pieces 1*a*-1*e*. As seen in FIG. 5, material 13 is mechanically bonded to the exposed fibers of the split finish outside surface 12 into a small portion of the underlying, microporous body of palm pieces 1*a*-1*e*. As such, the penetration is limited to less than the entire thickness of the material and preferably only a fraction of the thickness, for example, less than 25 percent. In this regard, substantial moisture absorbing or wicking capability is retained by inside surface 11 of palmar pieces 1*a*-1*e* thereby providing greater comfort and improved feel for the wearer. Additionally, the thickness of the material 13 and the geometry in which it is applied to outside surface 12 are important considerations if finger jackets 10 are to be successfully used. Thus, material 13 is applied to palm pieces 1*a*-1*e* in a continuous layer thereby covering outside surface 12. Moreover, in order to provide a skin-like tactile response, the layer of material 13 must be thin and smooth. The thickness of material 13 should be generally uniform over the entire outside surface 12 of palmar face pieces 1*a*-1*e*. Material 13 is applied to outside surface 12 of palm piece 1*a*-1*e* in any suitable manner. Such application may be carried out either before or after assembly of palm face pieces 1*a*-1*e* and may be accomplished by spraying, spreading, or otherwise coating outside surface 12.

The added anti-slip material about the thumb is placed about and above the proximal interphalangeal joint covering the tip of the thumb and along the inside of the thumb, the side closest to the index finger, however, not along the lower back portion of the thumb or proximal phalanx. Here, breathable stretchable material 2*a*-2*e* (FIG. 3) are used. Added anti-slip material is used for the index finger as well. Here, added anti-slip material is placed about and above the distal interphalangeal joint and along the inside of the index finger, the side closest to the thumb, however, not along the rest of the back portion of the finger jacket 10. Here, stretchable, breathable materials are used with the preferred materials being identified above.

The finger jackets 10 of the present invention offer a number of features not provided by prior art references. Wearing the finger jackets 10 provides the wearer superior tactility to that of any glove while still providing the benefits of its enhanced gripping capabilities. Another feature of the finger jacket 10 not found in other prior art is that the zipper 14 attached to the back of each finger jacket 10 allows for the finger jacket 10 to be opened up and for fingers to be more easily inserted into finger jackets 10. This allows a wide range of finger sizes the ability to fit into finger jackets 10 more readily, while still allowing for a more secure fit over this wide range of finger sizes.

As such, an invention has been disclosed in terms of preferred embodiments thereof that fulfill each and every one of the objects of the invention and provide new and useful finger jackets of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A set of finger jackets comprising:

a) five separate finger jackets, unconnected with one another, each separately sized to cover and configured solely for covering one of a user's thumb and forefinger, middle finger, ring finger and pinkie finger, a palm of a user's hand on which said fingers and thumb are located remaining uncovered and devoid of a palmar piece when said five separate finger jackets are covering said user's thumb and forefinger, middle finger, ring finger and pinkie finger;

b) each finger jacket including a palmar facing portion and a back portion joined adjacently to said palmar facing portion at fourchettes on each side thereof;

c) each back portion being made of a porous stretchable, breathable elastic material chosen from the group consisting of woven polyester, knit polyester, spandex, lycra and polypropylene, said material having an inner surface configured for directly physically contacting against respective back surfaces of said thumb and respective fingers;

d) each palmar facing portion being made of an anti-slip material that has an inner surface configured for directly physically contacting against respective palmar facing surfaces of said thumb and respective fingers.

2. The set of claim 1, wherein each finger jacket includes a releasable fastener.

3. The set of claim 2, wherein each said fastener comprises hook and pile fastening means.

4. The set of claim 2, wherein each said fastener comprises a zipper.

5. The set of claim 4, wherein each zipper is located on a respective back portion.

6. The set of claim 3, wherein each finger jacket includes a lower opening, each said hook and pile fastening means partially encircling a said opening.

7. The set of claim 1, wherein each palmar facing portion is made of a plurality of layers of material.

8. The set of claim 7, wherein one of said layers comprises a coating.

9. The set of claim 7, wherein one of said layers includes a surface covered with exposed fibers.

10. The set of claim 9, wherein one of said layers comprises a coating.

11. The set of claim 1, wherein said palmar facing portions are made of a material chosen from the group consisting of natural or synthetic rubber, leather, suede and synthetic leather.

12. The set of claim 1, wherein each said palmar facing portion is coated with a grip enhancing substance.

13. The set of claim 12, wherein said substance comprises a silicone material.

* * * * *